United States Patent [19]

Tsurumaru et al.

[11] Patent Number: 4,556,354

[45] Date of Patent: Dec. 3, 1985

[54] PROCESS FOR PRODUCTION OF BONDED CAN OF KEY-OPENING TYPE

[75] Inventors: Michiko Tsurumaru, Tokyo; Seiichi Nakazato, Yokohama; Atsushi Nunokawa, Kawasaki; Hiroshi Ueno, Yokosuka; Seishichi Kobayashi, Yokohama, all of Japan

[73] Assignee: Toyo Seikan Kaisha, Ltd., Tokyo, Japan

[21] Appl. No.: 722,474

[22] Filed: Apr. 12, 1985

Related U.S. Application Data

[62] Division of Ser. No. 597,859, Apr. 9, 1984.

[30] Foreign Application Priority Data

Apr. 9, 1983 [JP] Japan ..... 58-61534

[51] Int. Cl.[4] ..... B23P 11/02

[52] U.S. Cl. ..... 413/15; 413/7; 413/14; 413/54

[58] Field of Search ..... 413/1, 4, 7, 14, 15, 413/54, 55

[56] References Cited

U.S. PATENT DOCUMENTS

| | | | |
|---|---|---|---|
| 3,295,485 | 1/1967 | Gedde | 413/7 |
| 3,373,895 | 3/1968 | Arfert | 413/16 |
| 3,397,661 | 8/1968 | Allman | 413/16 |
| 3,734,044 | 5/1973 | Armus | 413/7 |
| 3,736,893 | 6/1973 | Coppens | 413/7 |
| 4,048,935 | 9/1977 | Beveridge | 413/1 |
| 4,508,481 | 4/1985 | Ishibash | 413/1 |

*Primary Examiner*—Leon Gilden

*Attorney, Agent, or Firm*—Sughrue, Mion, Zinn, Macpeak, and Seas

[57] ABSTRACT

Disclosed is a bonded can of the key-opening type comprising a coated metal blank and a seam formed by lap-bonding outer and inner end edge portions of the coated metal blank to each other by a tape of a thermoplastic resin adhesive, wherein the adhesive is a polyamide type or polyester type adhesive, the inner end edge portion forming the seam of the bonded can is completely covered with the adhesive tape, the outer edge portion has a winding-starting tongue piece integrated therewith, a plurality of scores are formed on the outer surface of the coated metal blank from the base of the tongue piece along the entire circumference inclusive of the seam, the scores have a knife angle of 45° to 120° and a depth corresponding to 8 to 45% of the thickness of the metal blank, a coating of an epoxy resin having a thermal softening point of 65° to 150° C. as measured according to the thermomechanical method is formed at least at the seam-forming part on the outer surface and said epoxy resin coating forms a continuous layer adhering closely to the metal blank even in the portion of said scores.

1 Claim, 12 Drawing Figures

FIG. 1
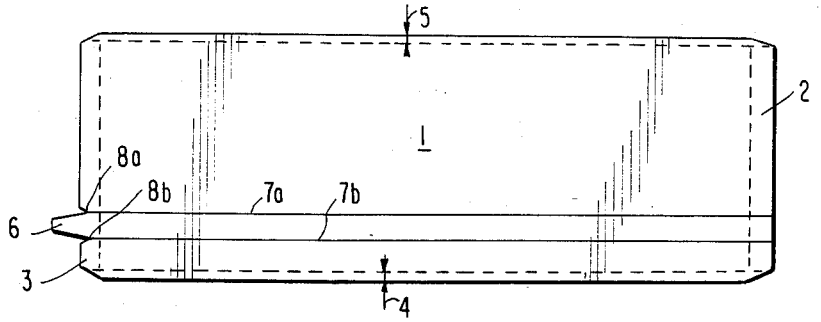
FIG. 2
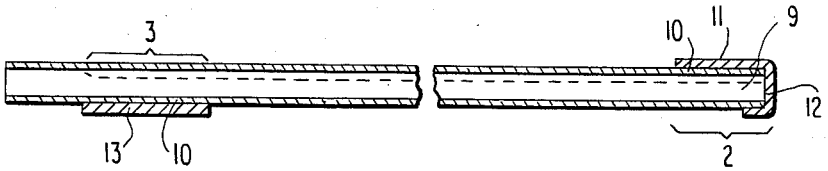
FIG. 3
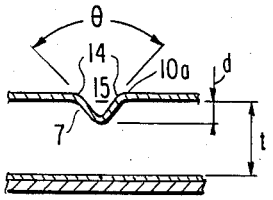
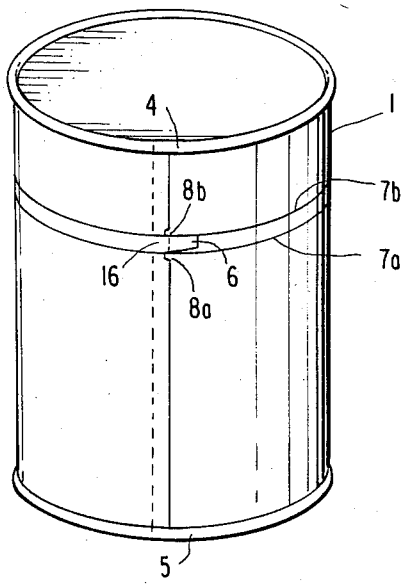
FIG. 4

FIG. 5
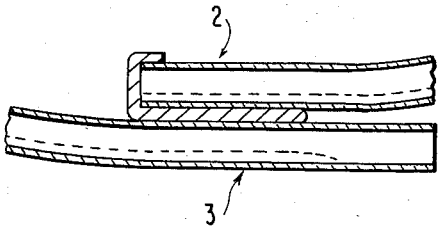
FIG. 6
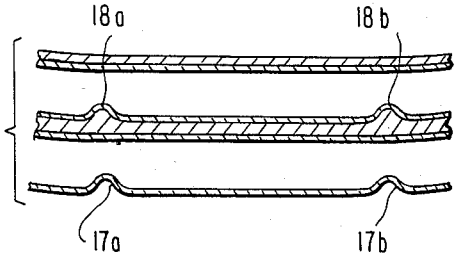
FIG. 7
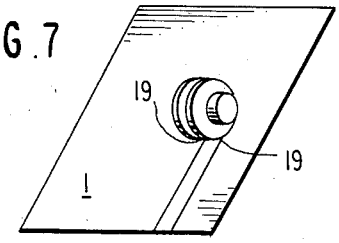
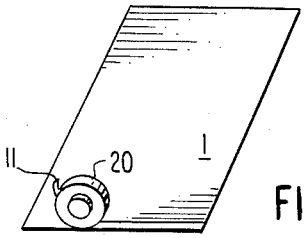
FIG. 8
FIG. 9
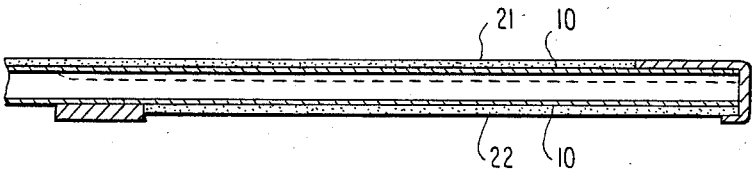
FIG. 10A
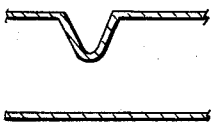
FIG. 10B
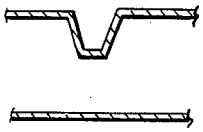
FIG. 10C
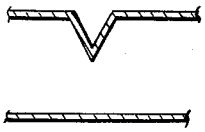

PROCESS FOR PRODUCTION OF BONDED CAN OF KEY-OPENING TYPE

This is a division of application Ser. No. 597,859, filed Apr. 9, 1984.

BACKGROUND OF THE INVENTION (1) Field of the Invention

The present invention relates to a bonded can of the key-opening type and a process for the production thereof. More particularly, the present invention relates to a bonded can of the key-opening type, which is excellent in the key-operability, corrosion resistance and hygienic qualities.

(2) Description of the Prior Art

Key-opening type cans have been widely used as the can for containing therein a livestock product such as corned beef, ham or luncheon meat. As a typical instance of a can of the key-opening type, there can be mentioned a tinplate can in which a seam is formed by soldering, a tongue piece is formed on the outer end portion of the seam and a plurality of scores are formed from the base of the tongue portion along the entire circumference. At the time of opening, the tongue piece is inserted in a winding key, scores are broken by turning the key and a strip-like tinplate between the scores is wound up to effect opening of the can.

This known can of the key-opening type has some serious defects because the seam is formed by soldering. Solder is an alloy of tin and lead and has bad influences on the content. In order to avoid these bad influences, use of wholly tin solder free of lead may be considered. However, the strength of the wholly tin solder is lower than that of the alloy solder, and therefore, when the wholly tin solder is used, it is difficult to form a seam which can resist high-temperature sterilization. At the time of opening, it is necessary to break scores while peeling the seam, and since the cohesive force of the solder is more than 10 times the cohesive force of a resin, a considerably large force is necessary at the start of key-opening of the can. Accordingly, troubles such as breakage of the tongue piece are often caused at the start of key-opening of the can. Furthermore, in case of a tinplate can, a sulfur-containing compound formed by decomposition of meat or the like reacts with metallic tin to cause black coloration, that is, so-called sulfide blackening.

A bonded can composed of tin-free steel (TFS) (such as an electrolytically chromium-coated steel plate) and having a side seam bonded by an adhesive of a thermoplastic resin such a nylon resin has recently been used as a can for carbonated beverages or other beverages instead of the above-mentioned soldered can. It seems strange that bonded TFS can of this type has not been used as a bonded can of the key-opening type. The reason is considered to be that such troubles as corrosion of the metal in the portion of scores and minute leakages through the scores present in the portion of the seam are not overcome in case of a TFS can blank.

SUMMARY OF THE INVENTION

It is therefore a primary object of the present invention to provide a can of the key-opening type having a seam bonded by a thermoplastic resin adhesive, in which the foregoing problems are solved.

Another object of the present invention is to provide a can of the key-opening type excellent in the hygienic qualities and sulfide blackening resistance, in which opening of the can by winding can easily be initiated with a relatively small force, corrosion of the metal in the portion of scores is controlled and leakages through scores on the seam are prevented.

Still another object of the present invention is to provide a can of the key-opening type in which the score portion of the can is covered with a continuous coating adhering closely thereto and in the seam bonded by a thermoplastic adhesive, the score portion is compactly filled with the adhesive.

In accordance with one fundamental aspect of the present invention, there is provided a bonded can of the key-opening type comprising a coated metal blank and a seam formed by lap-bonding outer and inner end edge portions of the coated metal blank to each other by a tape of a thermoplastic resin adhesive, wherein the adhesive is a polyamide type or polyester type adhesive, the inner end edge portion forming the seam of the bonded can is completely covered with the adhesive type, the outer edge portion has a winding-starting tongue piece integrated therewith, a plurality of scores are formed on the outer surface of the coated metal blank from the base of the tongue piece along the entire circumference inclusive of the seam, the scores have a knife angle of 45° to 120° and a depth corresponding to 8 to 45% of the thickness of the metal blank, a coating of an epoxy resin having a thermal softening point of 65° to 150° C. as measured according to the thermomechanical method is formed at least at the seam-forming part on the outer surface and said epoxy resin coating forms a continuous layer adhering closely to the metal blank even in the portion of said scores.

In accordance with another aspect of the present invention, there is provided a process for the production of bonded cans of the key-opening type, which comprises the steps of (A) forming a plurality of scores for key-opening of a can on a metal can blank along the entire length of a surface to be formed into an outer surface of the can, said metal can blank being provided with a coating of an epoxy resin having a thermal softening point of 65° to 105° C. as measured according to the thermomechanical method, which is formed at least at a seam-forming part on the surface to be formed into the outer surface of the can, and said scores having a knife angle of 45° to 120° C. and a depth corresponding to 8 to 45% of the thickness of the metal blank, (B) applying a tape of a thermoplastic adhesive of a polyamide or polyester type on the end edge portion, to be formed into an inner side of a seam, of the metal blank to wrap and cover said end edge portion with said tape, (C) shearing the metal blank so that a torque piece for key-opening of the can may be formed on the end edge portion, to be formed into an outer side of the seam, of the metal blank integrally therewith, and (D) forming the metal blank prepared through the steps (A), (B) and (C) into a can body, lapping the inner and outer end edge portions to each other through said adhesive tape, pressing the lapped end edge portions in the state where the adhesive is melted, and cooling and solidifying the adhesive to form a seam.

BRIEF DESCRIPTION OF THE DRAWINGS

FIG. 1 is a plane view of a can blank to be used in the present invention.

FIG. 2 is an enlarged sectional view of the can blank shown in FIG. 1.

FIG. 3 is an enlarged sectional view of a score of the metal blank shown in FIG. 1.

FIG. 4 is a perspective view of a bonded can of the key-opening type according to the present invention.

FIG. 5 is a view showing the section of the can shown in FIG. 4 in the portion of the seam, taken along the width direction of the seam.

FIG. 6 is a view showing the section of the can shown in FIG. 4 in the portion of the seam, taken along the length direction of the seam.

FIG. 7 is a diagram illustrating the step of forming scores on a metal can blank.

FIG. 8 is a diagram illustrating the step of applying an adhesive tape.

FIG. 9 is an enlarged sectional view showing another example of the coating structure of the can blank.

FIG. 10A, FIG. 10B and FIG. 10C are enlarged sectional views showing examples of the shape of scores.

DETAILED DESCRIPTION OF THE INVENTION

The present invention will now be described in detail with reference to the accompanying drawings.

Referring to FIG. 1 illustrating a bonded can of the key-opening type according to the present invention in a developed manner, this bonded can is composed of a coated metal blank indicated by reference numeral 1, and the blank 1 has an end 2 to be formed into an inner side of the seam on the right side of FIG. 1 and an end 3 to be formed into an outer side of the seam on the left side of FIG. 1. The upper and lower end portions of the metal blank are portions 4 and 5 for forming flanges to be double-seamed with can lids.

A tongue piece 6 for opening the can is formed on the end 3 to be formed into the outer side of the seam so that the tongue piece 6 projects outwardly of the edge of the end portion 3, and a plurality of scores 7*a* and 7*b* are formed in parallel to each other in the base portion of the tongue piece 6 so that the scores 7*a* and 7*b* extend along the entire length of the blank 1. In order to easily break the scores at the start of opening, it is preferred that notches 8*a* and 8*b* be formed on the base portion of the tongue piece 6.

Referring to FIG. 2 showing the section of the blank 1 in an enlarged manner, the blank 1 comprises a substrate 9 of a metal such as tin-free steel or aluminum and a primer coating 10 formed on the metal substrate 9. This primer coating 10 protects the metal substrate from corrosion and promotes the bonding action of a thermoplastic resin adhesive described hereinafter. A polyamide type or polyester type adhesive tape 11 is applied to the end portion 2 to be formed into the inner side of the seam so that a part of the tape 11 protrudes outwardly of the cut edge 12 of the end portion, and the tape 11 is bent back by 180° at the cut edge 12 to completely protect the cut edge 12. From the viewpoint of the adaptability to the bonding operation, an adhesive tape layer 13 is applied on the surface, to be lapped on the inner end portion 2, of the end portion 3 to be formed into the outer side of the seam.

Referring to FIG. 3 showing the score portion of the blank 1 in an enlarged manner, the section of the score 7 comprises a pair of inclined parts 14 and a bottom part 15 connected to the inclined parts 14, and the score 7 is defined by the knife angle ($\theta$), that is, the open angle between both the inclined parts 14, and the depth (d). In the bonded can of the present invention, as described in detail hereinafter, a continuous coating 10*a* adhering closely to the metal substrate 9 is formed along the entire surface of the score. This is one of the important features of the present invention.

According to the present invention, the can blank shown in FIGS. 1 through 3 is formed so that the inner end edge portion 2 and the outer end edge portion 3 are lapped together through the adhesive layer 11 or through the adhesive layers 11 and 13 and a can having a predetermined sectional shape is produced, as shown in the perspective view of FIG. 4 and the enlarged sectional views of FIGS. 5 and 6 illustrating the seam, and the adhesive is melted, pressed, cooled and solidified, whereby a bonded can is formed.

As is apparent from the drawings, in a lap seam 16 to be formed, score ends 17*a* and 17*b* located on the outer side of the can are lapped on the score ends 18*a* and 18*b* located in the seam. In this structure, from the viewpoint of prevention of leakage through the seam, it is a problem how to prevent leakage through the score ends 18*a* and 18*b*, and from the viewpoint of the adaptability to the can-opening operation, it is a problem how to perform smoothly shearing of the score ends 17*a* and 17*b* at first and the score ends 18*a* and 18*b* finally.

The present invention is characterized in that the score 7 is formed along the entire circumference of the can body so that the knife angle ($\theta$) is 45° to 120°, especially 60° to 100°, and the depth (d) of the score is 8 to 45%, especially 10 to 35%, of the thickness (t) of the metal substrate, an epoxy resin coating having a thermal softening point of 65° to 150° C. as determined according to the thermomechanic method described hereinafter is used for the coating 10 formed on the score-formed surface of the metal substrate, and that the can blank is lap-bonded under heating with a polyamide type or polyester type thermoplastic resin adhesive to obtain a bonded can of the key-opening type.

As pointed out hereinbefore, the most serious problems encountered in a bonded can of the type where a strip of a metal brink between a plurality of scores is wound up by a key are how to prevent minute leakages from scores located in the seam portion and how to prevent corrosion of the substrate metal in the portion of the scores.

The knife angle ($\theta$) of the score 7 has close relations to the easiness in breaking the scores at the start of key-opening of the can, the continuity of the coating in the score portion and the degree or completeness of the filling of the scores with the adhesive resin. If the knife angle of the score is smaller than 45°, the coating is damaged when the score is formed, corrosion of the metal takes place at the position of the score, the adhesion of the adhesive resin to the metal becomes incomplete in the damaged portion of the coating and leakage is readily caused with the lapse of time. Furthermore, flow-filling of the adhesive resin into the space of the score 7 becomes difficult and a void is readily formed in the score portion, and also for this reason, leakage is readily caused. On the other hand, if the knife angle is larger than 120°, shearing of the metal at the score 7 is difficult and it is difficult to form a score having a depth defined in the present invention.

In the bonded can of the key-opening type according to the present invention, since a metal substrate of TFS or aluminum is used and the seam is formed through the resin adhesive, even if the depth (d) of the score is not so great, the opening can easily be accomplished. This is another characteristic feature of the present invention.

For example, in case of a soldered can of the key-opening type, the score depth should be about 50% of the thickness of a tinplate. In contrast, in the present invention, if the score depth is 8 to 45% of the thickness of the metal substrate, the opening can easily be accomplished. Furthermore, since the score depth is thus reduced, corrosion of the metal at the score is prevented and the flow-filling of the adhesive resin into the score can easily be accomplished.

In the present invention, it is important that an epoxy resin coating having a thermal softening point within the above-mentioned range determined by the thermomechanical analysis method should be used. More specifically, it is necessary that this coating should be excellent in the adhesion to the metal substrate, the bonding force to the resin adhesive and the effect of preventing corrosion of the metal substrate. Among various lacquers, an epoxy resin lacquer is excellent the adhesion to a metal substrate and the bonding force to many adhesive resins, and therefore, this lacquer is especially suitable for attaining the objects of the present invention.

It is important that the epoxy resin coating should have a thermal softening point included within the above-mentioned range. This thermal softening point is a factor concerning the thermal motion of the molecule chain of the resin constituting the coating, and the value of the thermal softening point is a thermal physical value determined substantially irrespectively of the degree of curing of the resin, that is, the density of crosslinking points. If the thermal softening point of the coating is higher than 150° C., the coating is brittle and cracking or peeling is caused at the position of the score, with the result that corrosion and leakage are caused. If the thermal softening point of the coating is lower than 65° C., the adhesion to the metal substrate or the bonding force to the adhesive is reduced, and corrosion is readily caused at the heating sterilization because of permeation of corrosive components.

In a can of the key-opening type, a largest opening force is necessary for a seam of the can, that is, the part where the key-opening is started and the part where the key-opening is ended. As the peeling fracture of the seam, there may considered fractures at various positions, such as the cohesion fracture of the adhesive, the peeling in the interface between the adhesive and the coating, the cohesion fracture of the coating and the peeling in the interface between the coating and the metal. It is considered that the force causing the peeling by the cohesion fracture of the adhesive is largest among the forces causing these fractures. As pointed out hereinbefore, the cohesive force of the thermoplastic resin adhesive to be used in the present invention is about 1/10 of the cohesive force of solder. Accordingly, it will readily be understood that even if the comparison is made based on the above-mentioned largest fracture force, the key-opening can easily be accomplished in the seam portion with a considerably smaller force than the opening force necessary in a soldered can. Furthermore, in case of a soldered can, score grooves on the inner and outer sides of the seam are filled with a solder, which is a metal material of the same kind as that of the substrate, and therefore, shearing of the score portion is very difficult. In contrast, in the present invention, since score grooves are filled with an adhesive resin which is different from the metal material, not only initial shearing of scores but also final shearing of scores can be accomplished very easily. Therefore, the can body can easily be broken completely into upper and lower portions, and the content can easily be taken out.

In the present invention, any of can-forming metal materials, bonding of which by soldering is difficult, can optionally be used as the metal blank. For example, a tin-free steel (TFS) blank and an aluminum blank may be used. As the TFS blank, there is known a blank comprising a steel substrate such as a rolled steel plate and at least one chromium-containing covering layer selected from a metallic chromium covering layer and a non-metallic chromium covering layer, and this known TFS blank is preferably used for attaining the objects of the present invention. A chromium-containing covering layer having a thickness of 0.06 to 3.6 mg/dm$^2$, especially 0.1 to 2.5 mg/dm$^2$, as calculated as chromium is easily available and is preferably used in the present invention, though the thickness is not limited to the above value. Furthermore, an aluminum-deposited steel plate and a nickel-deposited steel plate may be used in some case.

As the aluminum blank, there may be used so-called pure aluminum and an aluminum alloy comprising aluminum as the main component and at least one alloying component selected from magnesium, manganese, silicon, iron and copper.

In the present invention, it is especially preferred that a TFS blank be used as the metal blank. More specifically, in a can of the key-opening type, when a metal blank has a relatively high rigidity, opening by shearing of scores can be accomplished more easily, and since a TFS blank is provided with a steel plate substrate, even if scores are relatively shallow, opening is effected easily. Furthermore, since the TFS blank is provided with a chromium-containing covering layer, the corrosion resistance and adhesion to the undercoating are excellent.

A chromium-containing covering layer comprising a metallic chromium layer formed on a steel plate substrate and a non-metallic chromium layer (chromium oxide and/or hydrated chromium oxide layer), in which the metallic chromium layer has a thickness of 0.05 to 2.0 mg/dm$^2$, especially 0.1 to 1.5 mg/dm$^2$, and the non-metallic chromium layer has a thickness of 0.01 to 0.4 mg/dm$^2$, especially 0.05 to 0.3 mg/dm$^2$, as calculated as chromium, is especially excellent in the corrosion resistance, the adaptability to formation of scores and the adhesion of the score portion to the coating.

It is ordinarily preferred that the thickness (t) of the metal blank be 0.10 to 0.60 mm, and it is especially preferred that the thickness of the metal blank be 0.12 to 0.35 mm in case of the TFS blank or 0.15 to 0.50 mm in case of the aluminum blank.

The epoxy resin type lacquer used as a protecting and adhesion-promoting lacquer in the present invention is a lacquer containing an epoxy resin. A polycondensate of a dihydric phenol with an epihalohydrin or a modification product thereof is used as the epoxy resin. As the dihydric phenol, there can be mentioned a compound represented by the following general formula:

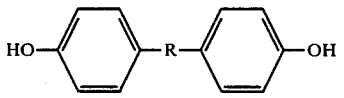

(1)

In the above general formula, as the bridging group R, there can be mentioned an alkylidene group $—CR^1R^2$ in which $R^1$ and $R^2$ stand for a hydrogen atom, a halogen atom or an alkyl or perhaloalkyl group having up to 4 carbon atoms, —O—, —S—, —SO—, $—SO_2—$ and $—NR^3—$ in which $R^3$ stands for a hydrogen atom or an alkyl group having up to 4 carbon atoms. Bisphenol A [2,2'-(4-hydroxyphenol)propane], bisphenol B [2,2'-(4-hydroxyphenyl)butane] and bisphenol F [bis-(4-hydroxyphenyl)methane] are preferably used for attaining the objects of the present invention.

Epichlorohydrin is preferably used as the epihalohydrin.

An epoxy resin obtained by polycondensation of a dihydric phenol with an epihalohydrin has ordinarily a number average molecular weight of 600 to 20,000, especially 800 to 15,000, and this resin is represented by the following general formula:

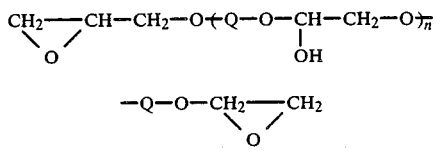

(2)

wherein Q stands for a condensation residue of the dihydric phenol and n is a number selected so as to give the above-mentioned molecular weight.

The epoxy resin may be used as the lacquer component as it is. Furthermore, it may be used in the form of a modified epoxy resin obtained by reacting the epoxy resin with a known modifier such as a higher fatty acid, an aromatic acid anhydride, a monohydric phenol, a carboxylic acid-containing acrylic oligomer, a dimer polyamide or rosin.

The epoxy resin component is ordinarily used as a primer in the form of a composition comprising the epoxy resin and other resin component acting as a curing agent for the epoxy resin and a coating-forming component.

As the resin to be combined with the epoxy resin, there can be mentioned a phenol-formaldehdye resin, a furan-formaldehyde resin, a xylene-formaldehyde resin, a ketone-formaldehyde resin, a urea-formaldehyde resin, a melamineformaldehyde resin, an alkyd resin, an unsaturated polyester resin, a bismaleimide resin, a thermosetting acrylic resin, a urethane resin, a vinyl chloride copolymer resin and a silicone resin.

As pointed out hereinbefore, it is important that the epoxy resin coating should have a thermal softening temperature of 65° to 150° C. as determined according to the thermomechanical method. The thermal softening temperature of the coating is considerably influenced by the kind and molecular weight of the skeleton of the epoxy resin and the kind and ratio of the curing agent resin to be combined with the epoxy resin.

Generally speaking, with increase of the ratio or molecular weight of the aromatic group introduced into the molecular chain of the lacquer resin, the thermal softening temperature of the coating tends to be high. First, the thermal softening temperature of the coating is changed by the carbon number and symmetry of the bridging alkylene group of the dihydric phenol included into the epoxy resin. For example, the thermal softening point tends to lower in the order of bisphenol A, bisphenol B and bisphenol F. Next, the thermal softening point of the coating tends to decrease with lowering of the glass transition temperature (Tg) of the curing agent resin. Furthermore, in case of a curing agent resin having a higher thermal softening temperature than that of the epoxy resin, for example, a phenolic resin, the thermal softening temperature is ordinarily increased with increase of the amount incorporated of the curing agent resin. If the thermal softening point of the curing agent resin is lower than that of the epoxy resin, the thermal softening temperature of the coating is lowered with increase of the amount incorporated of the curing agent resin.

In the present invention, the thermal softening temperature of the coating is appropriately adjusted within a certain range by selecting and combining the foregoing factors.

In view of the foregoing, it is preferred that the epoxy resin component (A) be combined with the curing agent resin (B) at a weight ratio of from 10/90 to 98/2, especially from 30/70 to 95/5.

The primer coating is ordinarily formed by applying an organic solvent solution of the above-mentioned resins having a concentration of 10 to 70% by weight to the metal blank and baking the solution at a temperature of 130° to 450° C. for 5 seconds to 20 minutes. It is preferred that the thickness of the primer coating be 0.5 to 20 microns, especially 1 to 10 microns.

Of course, optional additive components may be added to the primer coating according to need. For example, pigments such as titanium oxide, zinc oxide, iron oxide, aluminum oxide, aluminum hydroxide, aluminum powder and carbon black, slip agents such as hydrocarbon waxes and ester waxes, and flowability improving agents such as surface active agents may be incorporated.

A known polyamide or polyester type thermoplastic resin which is melted by heating and tightly adheres to the substrate during the melting and cooling steps is used as the thermoplastic resin adhesive in the present invention. From the viewpoint of the adaptability to the heat bonding operation, it is necessary that the thermoplastic resin should have a melting or softening point of 110° to 300° C.

As the polyamide resin, there can be mentioned polyamides having recurring units represented by the following general formula:

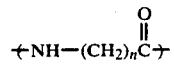

(3)

or

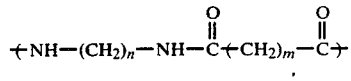

(4)

wherein n is a number of from 4 to 13 and m is a number of from 4 to 11, such as poly-ω-aminocaproic acid, poly-ω-aminoheptanoic acid, poly-ω-aminocaprylic acid, poly-ω-aminopelargonic acid, poly-ω-aminodecanoic acid, poly-ω-aminoundecanoic acid, poly-ω-aminotridecanoic acid, polyhexamethylene adipamide, polyhexamethylene sebacamide, polyhexamethylene dodecamide, polyhexamethylene tridecamide polydecamethylene adipamide, polydecamethylene sebacamide, polydecamethylene dodecamide, polydecamethylene tridecamide, polydodecamethylene adipamide, polydodecamethylene sebacamide, polydodecamethylene dodecamide, polydodecamethylene tridecamide, polytridecamethylene adipamide, polytridecamethylene sebacamide, polytridecamethylene dodecamide, polytridecamethylene tridecamide, polyhexamethylene azelamide, polydecamethylene azelamide, polydodecamethylene azelamide and polytridecamethylene azelamide, and copolyamides comprising at least two kinds selected from the above-mentioned amide units and blends comprising at least two members selected from the foregoing homopolyamides and copolyamides.

As the polyester resin, there can be mentioned (a) homopolyesters and copolyesters having recurring units represented by the following formula:

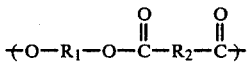

(5)

or

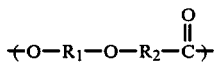

(6)

wherein $R_1$ stands for an alkylene group having 2 to 6 carbon atoms $R_2$ stands for an alkylene or arylene group having 2 to 24 carbon atoms, such as polyethylene adipate, polyethylene sebacate, polyethylene terephthalate, polytetramethylene isophthalate, polyethylene terephthalate/isophthalate, polytetramethylene terephthalate, polyethylene/tetramethylene terephthalate polyethylene hydroxybenzoate, and (b) polyester ethers comprising the above-mentioned ester recurring units and polyether units, such as polytetramethylene/-polyoxyethylene terephthalate.

These polyesters may be used singly or in the form of mixtures of two or more of them. Furthermore, these polyesters may be used in the form of blends with other thermoplastic resin such as olefin type resins, for example, polyethylene, polypropylene, ethylene/propylene copolymers, ethylene/butene-1 copolymers, ion-cross-linked olefin copolymers (Ionomers), ethylene/vinyl acetate copolymers, ethylene/acrylic acid copolymers, acid-modified polyethylene and acid-modified polypropylene. Of course, the olefin resin is incorporated in an amount of up to 50% by weight, especially up to 30% by weight, based on the entire adhesive.

The adhesive resin used in the present invention should have such a property that under melting conditions, the adhesive resin promptly flows into score grooves having the above-mentioned shape and size closely and compactly and fills the score grooves completely. In view of this property and from the viewpoint of the adaptability to the heat bonding operation, it is especially preferred that the melt viscosity ratio ($R\eta$), defined by the following formula, of the adhesive resin used in the present invention be lower than 0.80:

$$R\eta = \eta(Tm+20)/\eta(Tm+40)$$

wherein $\eta(Tm+20)$ represents the melt viscosity of the resin at a temperature higher by 20° C. than the softening or melting point of the resin and $\eta(Tm+40)$ represents the melt viscosity of the resin at a temperature higher by 40° C. than the softening or melting point of the resin.

The temperature dependency of the melt viscosity of a resin having the above-mentioned viscosity ratio, especially a polyamide or polyester, is large, and this resin flows in a score groove between edges to be bonded sufficiently under heat bonding conditions to form a seam excellent in the resistance to micro-leakage and the resistance to leakage with the lapse of time.

The bonded can of the key-opening type according to the present invention is prepared by forming a can blank through a combination of the score-forming step (A), the adhesive tape-applying step (B) and the shearing step (C) and subjecting the formed can blank to the bonded can-forming step (D).

At the score-forming step (A), as shown in FIG. 7, a score-forming blade 19 is caused to act on a coated metal blank 1. In the embodiments illustrated in FIGS. 1 through 6, two score lines are formed, but three score lines passing through both the sides of the root portion of the tongue piece and the central portion of the tongue piece, respectively, may be formed. Furthermore, two pairs of score lines may be formed on both the sides of the root portion of the tongue piece, respectively, so that the two lines of each pair are separated from each other by a small distance. According to the present invention, by forming scores having the above-mentioned shape and size on the coated metal blank, even if the thickness of the coating is reduced in the score portion, the coating adheres to the metal in the continuous form. This fact can be confirmed from a microscope photograph of the section or by the enamel rater test.

Ordinarily, the above-mentioned primer coating is formed on the entire surface of the metal blank, but the primer coating may be formed on the portion, to be formed into a seam, of the outer surface of the metal blank according to need.

At the adhesive tape-applying step (B), as shown in FIG. 8, an adhesive tape 11 is applied to the coated metal blank 1 by a film applicator 20. If the edge portion to which the tape is to be applied is preliminarily heated by high frequency induction heating or the like, preliminary bonding and fixation of the tape can be facilitated. Covering of the cut edge with the tape can easily be accomplished by bending the portion of the tape protruding from the cut edge by blowing of air or brushing. In the present invention, since the end portion opposite to the end portion where the tongue piece 6 is formed is located on the inner surface side of the obtained can, the cut edge located in the interior of the can may be covered very easily.

At the shearing step (C), the metal blank 1 is engaged with a press mold having a predetermined shape and is punched.

The order of the steps is not limited to the above-mentioned order. For example, there may be adopted a method in which the steps (A) and (C) are conducted in this order or reverse order or simultaneously and the adhesive tape-applying step (B) is then conducted.

At the bonded can forming step (D), the blank which has been subjected to the predetermined treatments is fed to a can-forming machine and molded to have a predetermined shape, and the side edge portions to be formed into a seam are heated by high frequency induction heating to melt or soften the adhesive resin. Finally, the heated side edge portions are lapped together and pressed under cooling.

When the seam is formed, it is preferred that the lap width be 1 to 20 mm, especially 2 to 10 mm, and that the thickness of the adhesive layer present in the seam be 0.01 to 0.25 mm, especially 0.02 to 0.15 mm.

The size of the tongue piece and the score distance may be changed according to the size of the can. However, since key-opening of the bonded can of the present invention is easy, if the score distance is 2 to 20 mm and the length of the tongue piece is 2 to 15 mm, a satisfactory openability can be obtained.

The formed can body is subjected to the flanging treatment and double seaming with a lid according to known procedures to form a can of the key-opening type.

Various modifications may be made to the bonded can of the present invention.

For example, at an optional stage before or after formation of the can body, as shown in FIG. 9, an anti-corrosive topcoat 21 may be formed on a primer coating 10 and an anti-corrosive innermost coating 22 may be formed on the inner surface.

The sectional shape of the scores is not particularly critical. For example, there may be adopted a round-bottomed shaped as shown in FIG. 10A, a flat-bottomed frustoconical shape and a V-figured shape.

The shape of the can is not particularly critical. For example, there may be adopted a circular or angular cross-sectional shape. Furthermore, the sectional area is uniform in the direction of the height, or a shape of a frustum of a cone or pyramid may be adopted. Since the bonded can of the key-opening type according to the present invention can easily be separated into upper and lower members by key-opening, even if the ratio of the height to the bottom area is made considerably larger than in conventional cans of the key-opening type, opening and take-out of the content can easily be done.

The present invention will now be described in detail with reference to the following Examples that by no means limit the scope of the invention.

The thermal softening temperature of the undercoating lacquer and the melt viscosity of the adhesive were determined according to the following methods.

Thermal Softening Temperature of Coating

A disc having a diameter of 3 mm was punched out from a coated plate, and according to the penetration method using a thermomechanical analysis (TMA) apparatus, the measurement was carried out at a temperature-elevating rate of 5° C./min under a load of 5 g by using a quartz needle having a top end radius R of 50μ and a top end angle of 60°. The thermal softening temperature was determined from a chart showing the relation between the temperature and the peneration of the needle.

Melt Viscosity Ratio of Adhesive

By using a cone plate rheometer, the melt viscosity ($\eta Tm+20$) at a temperature higher by 20° C. than the softening or melting point of the adhesive and the melt viscosity ($\eta Tm+40$) at a temperature higher by 40° C. than the softening or melting point of the adhesive were measured, and the melt viscosity ratio ($\eta Tm+20/\eta Tm+40$) was calculated.

The properties of the bonded can were evaluated according to the following methods.

Peel Strength after Retorting

Water maintained at 85° C. was filled in a can having a bottom lid double-seamed therewith, and a top lid was then double-seamed to the can. The can was retorted at 130° C. for 1 hour and was then cooled to room temperature. The top and bottom lids were removed and the bonded portion was cut out. The T-peel strength of the bonded portion was measured by a tensile tester. Each of the values shown in Tables was a mean value obtained with respect to 10 samples.

Examination of Leakage

Cans filled and retorted in the same manner as in case of samples for determination of the peel strength were stored at 37° C. After the lapse of one week, the vacuum degree was measured for 200 cans for each condition and the leaking cans were checked. Furthermore, 200 cans for each condition were stored for 6 months, and the leaking cans were similarly checked.

Blue Dye Test

A can filled with a blue dye solution (a 2% solution of Methyl Violet B in butyl cellosolve) was compressed under an inner pressure of 2 kg/cm$^2$, and the top and bottom lids were removed, and the bonded part of the core portion was peeled and permeation of the blue dye into the bonded part was examined by a stereomicroscope.

The can was fixed in a vessel filled with the dye solution so that the bonded score portion was completely immersed in the dye solution, and an outer pressure of 2 kg/cm$^2$ was imposed. After the lapse of 1 hour, the length of permeation of the blue dye into the bonded score portion was measured in the same manner as described above.

Rusting of Score Portion on Outer Surface

A can filled with water was subjected to the cycle of retorting at 130° C. for 30 minutes and cooling three times and was then allowed to stand still at room temperature for one week. The rusting at the score portion on the outer surface of the can was observed with the naked eye and the rusting degree was evaluated based on the ratio of the rusting length to the entire length of the score portion.

Openability

An opening tongue piece for key-opening was inserted into an opening key and the key was turned along the can body to cut off the portion of the can body between two confronting score lines and open the can by winding. The openability and windability were compared with those of a commercially available tinplate can of the same type.

Actual Can Test

1. Luncheon Meat:

190 g of luncheon meat composed mainly of chicken was filled in a can according to customary procedures and was subjected to the retorting treatment at 120° C. for 90 minutes. The filled can was stored at room temperature for 1 year, and the top and bottom lids were removed and the rusting and discoloration of the score portion of the side seam on the inner surface of the can were examined with the naked eye. Incidentally, 50 cans were tested for each condition.

2. Corned Beef:

270 g of new corned beef was filled in a can according to customary procedures and was subjected to the retorting treatment at 120° C. for 120 minutes. The filled can was stored at room temperature for 1 hour, and in the same manner as at the luncheon meat test, the can was opened and evaluated.

EXAMPLES 1 THROUGH 6 AND COMPARATIVE EXAMPLES 1 THROUGH 4

An epoxy-phenolic resin lacquer (epoxy resin/-phenolic resin weight ratio was 60/40) comprising a bisphenol B-type epoxy resin and carbolic resol and providing a baked coating having a thermal softening temperature of 140° C. was roll-coated in a thickness of 25 mg/dm$^2$ on both the surfaces of TFS having a coating comprising 80 mg/m$^2$ of metallic chromium and 20 mg/m$^2$ of non-metallic chromium, and the coating was baked at 205° C. for 10 minutes. A printing finish varnish was applied to the outer surface of the coated plate except the adhesive-applied portion of the can body according to customary procedures, and an epoxy/-phenolic lacquer containing 8 PHR of a release agent (wax) was roll-coated in a thickness of 50 mg/dm$^2$ on the inner surface of the coated plate and was baked at 190° C. for 10 minutes.

The coated plate was cut into a body blank having a width of 235.5 mm and a height of 75 mm, and an adhesive tape comprising a blend of nylon 13 and a nylon 12 copolymer (melt viscosity ratio of 0.62) and having a thickness of 40 μm and a width of 8 mm was folded on the inner end edge portion of the can to cover the inner end edge portion. Then, a similar adhesive tape having a width of 6 mm was applied to the outer end edge portion of the can to be bonded to the inner face portion.

A pair of score lines having a width of 6 mm were formed on the can body blank in the longitudinal direction under conditions shown in Table 1 by a scoring machine. Then, the remaining portion other than an opening tongue piece connected to the score portion was cut off, and a notch was formed on the portion to be side-seamed according to a customary method. The can body blank was formed into a 190-gram rectangular can for luncheon meat by an inverted body maker, and both the edge portions was subjected to high frequency induction heating to melt the resins and was compressed and cooled to form a can body. Then, a lid for a 190-gram rectangular can for luncheon meat was double-seamed to the bottom of the can body.

The obtained can was subjected to the above-mentioned tests. The obtained results are shown in Table 1.

TABLE 1

| | Shape of Score | | | | Peel Strength | Number of Leaking Cans | |
|---|---|---|---|---|---|---|---|
| | Knife angle (o) | Thickness (mm) | Score depth (mm) | d/t × 100 (%) | (kg/5 mm) after Retorting | 1 week after Retorting | After 6 Months' Storage |
| Example 1 | 50 | 0.23 | 0.030 | 13 | 5.4 | 0/200 | 0/200 |
| Example 2 | 90 | " | " | " | 5.6 | " | " |
| Example 3 | 110 | " | " | " | 5.2 | " | " |
| Example 4 | 80 | 0.22 | 0.022 | 10 | 6.2 | " | " |
| Example 5 | 90 | " | 0.044 | 20 | 6.0 | " | " |
| Example 6 | 100 | " | 0.077 | 35 | 6.4 | " | " |
| Comparative Example 1 | 40 | 0.23 | 0.034 | 15 | 6.3 | " | 3/200 |
| Comparative Example 2 | 135 | " | 0.023 | 10 | 5.9 | " | 0/200 |
| Comparative Example 3 | 90 | 0.22 | 0.013 | 6 | 5.6 | " | " |
| Comparative Example 4 | 70 | " | 0.11 | 50 | 5.2 | 3/200 | 12/200 |

| | Dyeing length (mm) in score portion at blue dye test | Rusting degree (%) of score portion on outer surface | Openability | After 1 year's standing at actual can test |
|---|---|---|---|---|
| Example 1 | 0 | 0 | easy | good |
| Example 2 | 0 | 0 | easy | good |
| Example 3 | 0 | 0 | easy | good |
| Example 4 | 0 | 0 | easy | good |
| Example 5 | 0 | 0 | easy | good |
| Example 6 | 0 | 0 | easy | good |
| Comparative Example 1 | 1.5 | 15 | easy | rusting in side seam and inner surface of score portion |
| Comparative Example 2 | 0 | 0 | impossible | good |
| Comparative Example 3 | 0 | 0 | impossible | good |
| Comparative Example 4 | 4.0 | 70 | easy | rusting in side seam and inner surface of score portion |

EXAMPLES 7 THROUGH 12 AND COMPARATIVE EXAMPLES 5 THROUGH 7

An undercoating lacquer shown in Table 2 (having a composition shown in Table 3) was stripe-coated along a width of 6 mm on the inner and outer surfaces of the end edge portions, to be formed into a bonded portion of a can body, of a TFS plate having a thickness of 0.24 mm and a coating comprising 50 mg/m$^2$ of metallic chromium and 15 mg/m$^2$ of non-metallic chromium, and the outer surface of the can body except the bonded portion was printed and coated with a varnish according to customary procedures. Then, the inner surface was similarly coated with an epoxy/phenolic lacquer containing 0.5 PHR of a lanolin type wax in an amount of 40 mg/dm$^2$, followed by baking. The coated printed plate was punched into a corned beef can No. 1 having a tongue piece for key-opening, and two pairs of confronting score lines for key-opening were formed on the extension of the tongue piece on the can body at a knife angle of 80° and a score depth of 40 μm by an ordinary scoring machine.

An adhesive tape having a width of 6 mm and shown in Table 2 was folded and bonded on the inner face of the outer end edge to be formed into the bonded portion of the can body, and a similar adhesive tape was folded and bonded along 5 mm onto the inner end edge and along 8 mm onto the cut face. The can body blank was formed in a pyramid shape corresponding to a corned beef can No. 1, and both the edge portions were lapped and heated by high frequency induction heating to melt the adhesive tapes, followed by compression molding and cooling, whereby a can body was formed.

An ordinary coated tinplate lid was double-seamed to the bottom of the can body having a shape of a pyramid.

The can was subjected to the above-mentioned tests. The obtained results are shown in Table 2.

TABLE 2

| | Materials Used | | Softening temperature | Melt viscosity ratio of adhesive | Peel strength |
|---|---|---|---|---|---|
| | Undercoating lacquer | Adhesive | (°C.) of coating | $\eta(Tm + 20)/\eta(Tm + 40)$ | (kg/5mm) after retorting |
| Example 7 | epoxy/phenolic (A) | nylon 612 | 147 | 0.57 | 6.6 |
| Example 8 | epoxy/phenolic (B) | " | 121 | " | 6.3 |
| Example 9 | epoxy/phenolic (C) | " | 69 | " | 5.9 |
| Example 10 | epoxy/amino | " | 106 | " | 5.7 |
| Example 11 | epoxy/ester | polyester-ether copolymer | 87 | 0.74 | 5.5 |
| Example 12 | epoxy/vinyl | polyester-ether copolymer | 76 | " | 5.3 |
| Comparative Example 5 | epoxy/phenolic (D) | nylon 612 | 155 | 0.57 | 6.1 |
| Comparative Example 6 | epoxy/phenolic (E) | " | 62 | " | 5.4 |
| Comparative Example 7 | epoxy/phenolic (B) | maleic acid-modified polypropylene | 121 | 0.83 | 5.2 |

| | Number of Leaking Cans | | |
|---|---|---|---|
| | 1 week after retorting | 6 months after retorting | Dyeing length (mm) in score portion at blue dye test |
| Example 7 | 0/200 | 0/200 | 0 |
| Example 8 | " | " | 0 |
| Example 9 | " | " | 0 |
| Example 10 | " | " | 0 |
| Example 11 | " | " | 0 |
| Example 12 | " | " | 0 |
| Comparative Example 5 | 16/200 | 137/200 | 4.2 |
| Comparative Example 6 | 57/200 | 200/200 | 4.0 |
| Comparative Example 7 | 121/200 | 200/200 | 3.3 |

TABLE 3

| Composition of Lacquer | | | |
|---|---|---|---|
| Lacquer | Epoxy Resin (I) (number average molecular weight | Resin (II) for Curing Epoxy Resin | (I)/(II) Weight Ratio |
| epoxy/phenolic (A) | bisphenol A-type epoxy resin (6,450) | butyl etherified carbolic acid resol type phenolic resin | 55/45 |
| epoxy/phenolic (B) | bisphenol B-type epoxy resin (3,700) | m-cresol resol type phenolic resin | 70/30 |
| epoxy/phenolic (C) | bisphenol F-type epoxy resin (1,900) | nonyl phenol-modified carbolic acid resol type phenolic resin | 80/20 |
| epoxy/phenolic (D) | bisphenol A-type epoxy resin (8,750) | xylenol-modified carbolic acid resol type phenolic resin | 30/70 |
| epoxy/phenolic (E) | bisphenol F-type epoxy resin (1,550) | aminophenol-modified m-cresol type phenolic resin | 85/15 |
| epoxy/amino | bisphenol B-type epoxy resin (4,900) | butyl etherified benzoguanamine resin | 85/15 |
| epoxy/ester | bisphenol A-type epoxy resin (900) | dehydrated castor oil | 60/40 |
| epoxy/vinyl | bisphenol F-type epoxy resin (2,550) | vinyl chloride/vinyl acetate maleic anhydride terpolymer | 45/55 |

EXAMPLE 13

An epoxy/phenolic lacquer (weight ratio of 65/35) having a thermal softening temperature of 130° C. and comprising a bisphenol A-type epoxy resin and a xylene resin-modified p-tert-butyl phenol resol was coated and baked in an amount of 30 mg/dm$^2$ on a plate of aluminum alloy 5052 having a thickness of 0.27 mm and a chemical treatment comprising 25 mg/m$^2$, as calculated as metallic chromium, of a chromium component.

An epoxy/urea lacquer was coated in an amount of 40 mg/dm$^2$ on the inner surface except the portion to be bonded, and the outer surface was printed and coated with a lustering varnish. A can body blank having scores and an opening tongue piece was formed from the coated plate in the same manner as described in Example 1.

The blank was formed into a cylindrical can be a roll forming machine, and the side edge portions to be bonded were subjected to high frequency heating, compressed and cooled to form a cylindrical can body. Then, the can body was flanged and one end of the can body was double-seamed with a coated aluminum bottom lid.

The can was filled with Vienna sausage and tomato sauce-incorporated brine was poured into the can, and the retorting treatment was carried out at 120° C. for 90 minutes. The filled can was stored at 37° C. for 6 months, and then, the states of the inner and outer surfaces of the can were examined.

Leakage or rusting was not observed in the score portion or bonded portion, and no corrosion was observed on the score portion of the inner surface. Thus, it was confirmed that the can had a good adaptability to the storage of the content.

What is claimed is:

1. A process for the production of bonded cans of the key-opening type, which comprises the steps of (A) forming a plurality of scores for key-opening of a can on a metal can blank along the entire length of a surface to be formed into an outer surface of the can, said metal can blank being provided with a coating of an epoxy resin having a thermal softening point of 65° to 105° C. as measured according to the thermomechanical method, which is formed at least at a seam-forming part on the surface to be formed into the outer surface of the can, and said scores having a knife angle of 45° to 120° and a depth corresponding to 8 to 45% of the thickness of the metal blank, (B) applying a tape of a thermoplastic adhesive of a polyamide or polyester type on the end edge portion, to be formed into an inner side of a seam, of the metal blank to wrap and cover said end edge portion with said tape, (C) shearing the metal blank so that a tongue piece for key-opening of the can may be formed on the end edge portion, to be formed into an outer side of the seam, of the metal blank integrally therewith, and (D) forming the metal blank prepared through the steps (A), (B) and (C) into a can body, lapping the inner and outer end edge portions to each other through said adhesive tape, pressing the lapped end edge portions in the state where the adhesive is melted, and cooling and solidifying the adhesive to form a seam.

* * * * *